US010883272B1

(12) United States Patent
Ortin et al.

(10) Patent No.: US 10,883,272 B1
(45) Date of Patent: Jan. 5, 2021

(54) FASCIA WITH SEAL FOR DRIP PROTECTION

(71) Applicant: Metal-Era, Inc., Waukesha, WI (US)

(72) Inventors: Travis Ortin, Milwaukee, WI (US); Christopher M. Parent, Mukwonago, WI (US)

(73) Assignee: METAL-ERA, INC., Waukesha, WI (US)

( * ) Notice: Subject to any disclaimer, the term of this patent is extended or adjusted under 35 U.S.C. 154(b) by 0 days.

(21) Appl. No.: 16/663,493

(22) Filed: Oct. 25, 2019

(51) Int. Cl.
*E04D 13/15* (2006.01)

(52) U.S. Cl.
CPC ..... *E04D 13/15* (2013.01)

(58) Field of Classification Search
None
See application file for complete search history.

(56) References Cited

U.S. PATENT DOCUMENTS 4,707,954 A * 11/1987 Butzen ..... E04D 13/155 52/60
5,189,853 A * 3/1993 Braine ..... E04D 13/15 52/219
7,451,572 B1 * 11/2008 Inzeo ..... E04D 3/405 52/300
9,284,734 B1 * 3/2016 Inzeo ..... E04D 13/155
10,087,636 B2 * 10/2018 Arnold ..... E04D 13/15
10,316,521 B1 * 6/2019 Van Dam ..... E04D 13/0459
2018/0230695 A1 * 8/2018 Arnold ..... E04D 13/158

OTHER PUBLICATIONS

Metal-Era Print Approval of Anchor Tite Standard Fascia. The Anchor Tite product was sold more than one year before the date of filing of the present application.

* cited by examiner

*Primary Examiner* — Joshua K Ihezie
(74) *Attorney, Agent, or Firm* — Donald J. Ersler

(57) ABSTRACT

A fascia with seal for drip protection preferably includes a fascia and a strip of compressible tape. The fascia includes an anchor bar and a cover. The cover snaps unto the anchor bar. The anchor bar includes a vertical portion, a roof flange, an upper cover clip and a lower cover clip. The strip of compressible tape is applied to an inside surface of the vertical portion, below a bottom of the roof flange. The top peripheral edge of a building is not perfectly flat. However, the flexibility of the anchor bar and the compressibility of the strip of compressible tape conforms to any dips in the roof membrane, which over lays the top peripheral edge of the building. A plurality of fasteners are used to secure the anchor bar to the top peripheral edge of the building to ensure that there is not a leak path for any water.

10 Claims, 3 Drawing Sheets

FASCIA WITH SEAL FOR DRIP PROTECTION

BACKGROUND OF THE INVENTION

1. Field of the Invention

The present invention relates generally to roofing and more specifically to a fascia with seal for drip protection, which protects a top outer peripheral edge of a building from experiencing water damage from water escaping between a fascia and a roof membrane.

2. Discussion of the Prior Art

A top peripheral edge of a flat roof building is normally finished with a fascia. A top of the flat roof is covered with a roof membrane, the roof membrane continues over the top outer peripheral edge of the building. The fascia includes a roof flange, which must be sealed to the roof membrane. The sealing is accomplished by applying a non-curing sealant between the roof membrane and the roof flange of the fascia. The sealant application process must be done by hand with the associated cost of extra labor. Since the caulking process is done by hand, it is also susceptible to error. It appears that the prior art does not disclose a fascia with seal for drip protection, which eliminates the need for the extra sealant application process.

Accordingly, there is a clearly felt need in the art for a fascia with seal for drip protection, which protects a top outer peripheral edge of a building from experiencing water damage from water escaping between a fascia flange and a roof membrane; and which eliminates the need for an extra sealant application during installation.

SUMMARY OF THE INVENTION

The present invention provides a fascia with seal for drip protection, which eliminates the need for an extra sealant application during installation. The fascia with seal for drip protection (fascia with seal) preferably includes a fascia and a strip of compressible tape. The fascia includes an anchor bar and a cover. The cover snaps unto the anchor bar. The anchor bar preferably includes a vertical portion, a roof flange, an upper cover clip and a lower cover clip. The strip of compressible tape is applied to an inside surface of the vertical portion, below a bottom of the roof flange. The top outer peripheral edge of a building is not perfectly flat. However, the flexibility of the anchor bar and the compressibility of the strip of compressible tape conforms to any dips in the roof membrane, which over lays the top outer peripheral edge of the building. A plurality of fasteners are used to secure and force the anchor bar against the top outer peripheral edge of the building to ensure that there is not a leak path for any water to drip past the strip of compressible tape.

Accordingly, it is an object of the present invention to provide a fascia with seal, which protects a top outer peripheral edge of a building from experiencing water damage from water escaping between a fascia and a roof membrane.

Finally, it is another object of the present invention to provide a fascia with seal, which eliminates the need for an extra sealant application step during installation.

These and additional objects, advantages, features and benefits of the present invention will become apparent from the following specification.

DETAILED DESCRIPTION OF THE PREFERRED EMBODIMENTS

Figure 1:
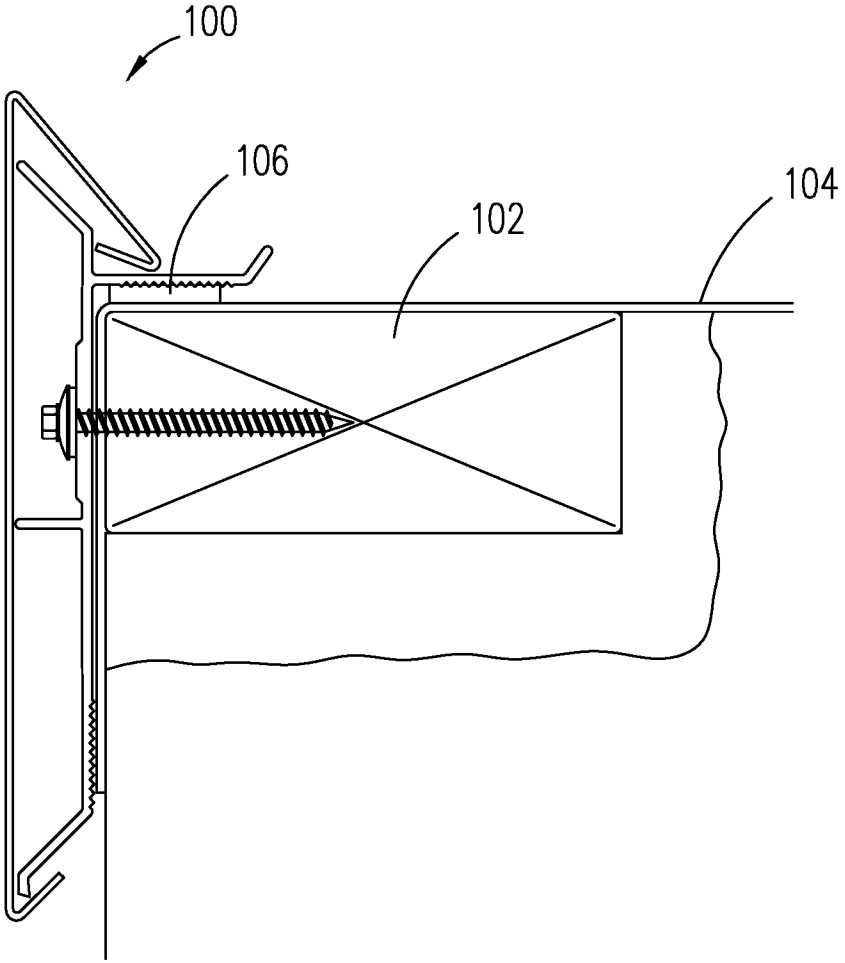
FIG. 1 (PRIOR ART)
FIG. 1 is an end view of a prior art fascia attached to a roof nailer with a non-curing sealant applied between a roof flange of the prior art fascia and a roof membrane.
Figure 2:
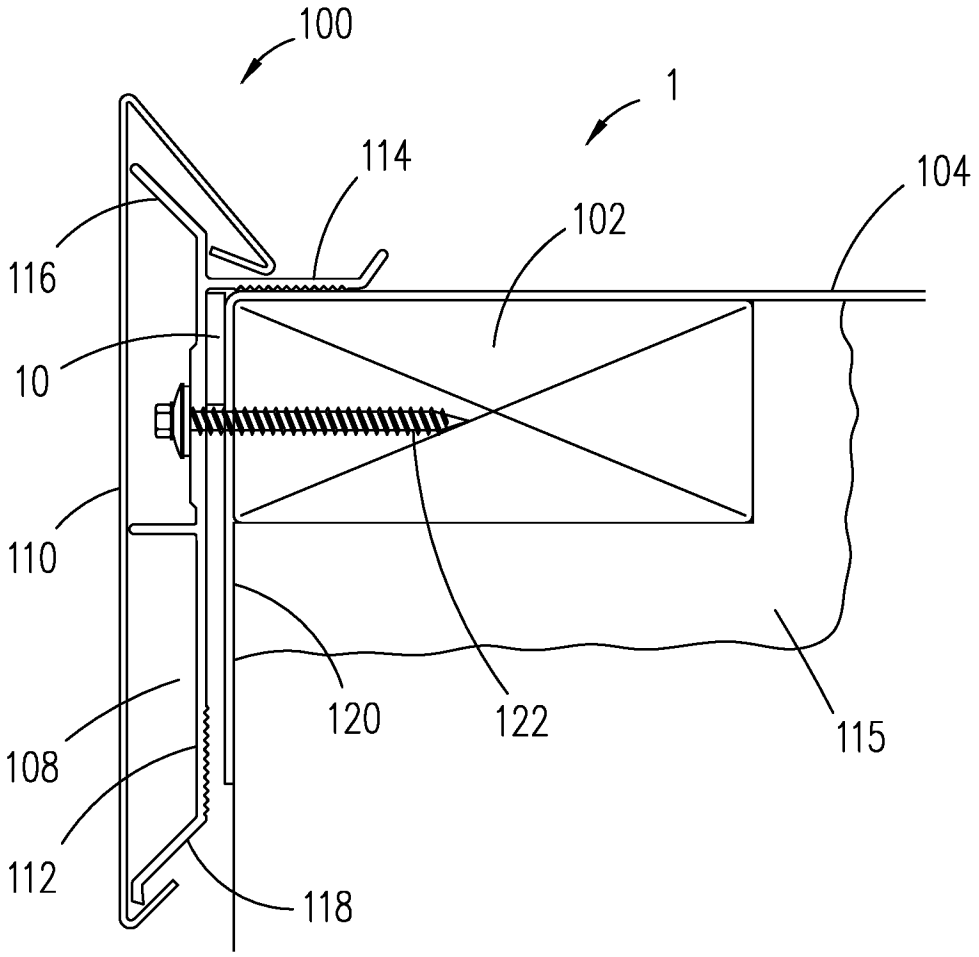
FIG. 2 is an end view of a fascia with seal attached to a roof nailer with a plurality of fasteners, which compresses a compressive strip of tape against a top outer peripheral edge of a building in accordance with the present invention.
Figure 3:
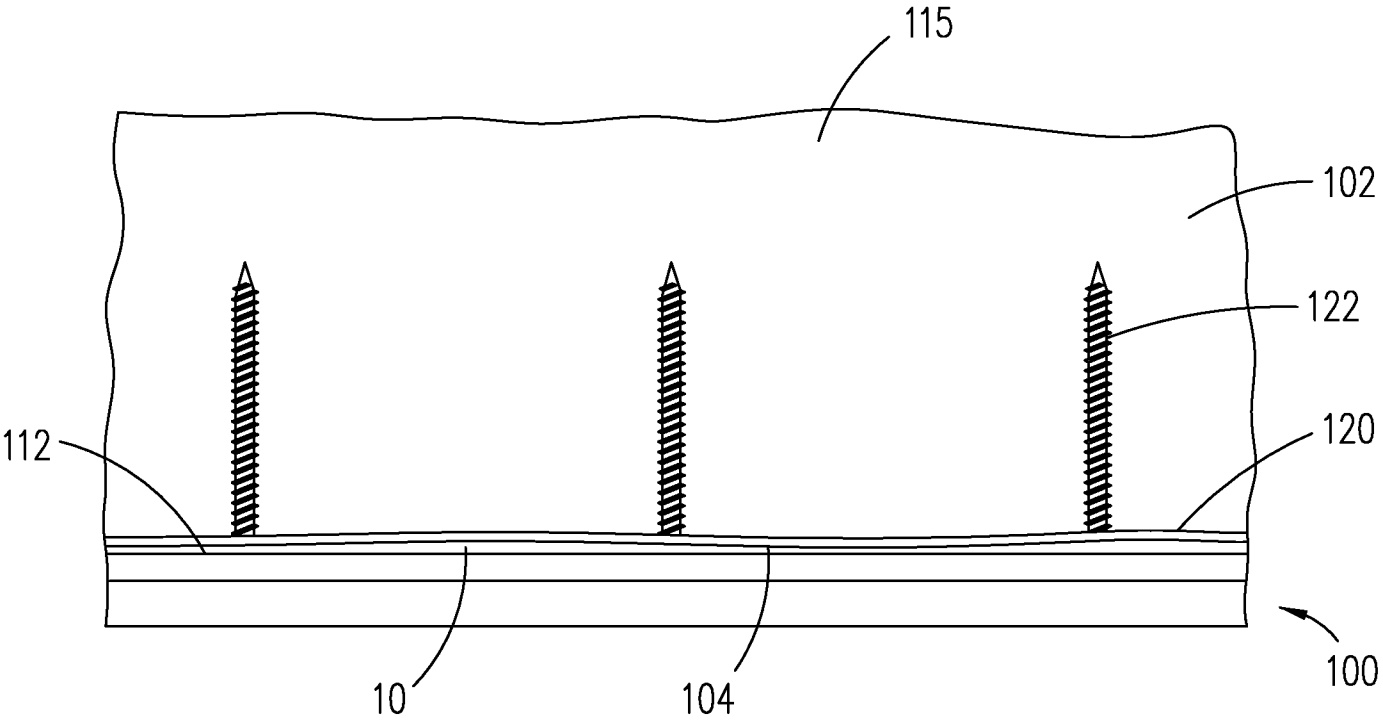
FIG. 3 is a bottom view of a fascia with seal for drip protection attached to a roof nailer with a plurality of fasteners, which compress a compressive strip of tape against a top outer peripheral edge of a building in accordance with the present invention.

With reference now to the drawings, and particularly to FIG. 2, there is shown an end view of a fascia with seal 1. FIG. 1 illustrates a side view of a prior art fascia 100 secured to a roof nailer 102 and sealed to a roof membrane 104 with a non-curing sealant 106. The fascia with seal 1 preferably includes the fascia 100 and a strip of compressible tape 10. The fascia 100 includes an anchor bar 108 and a cover 110. The cover 110 snaps unto the anchor bar 108. The anchor bar 108 preferably includes a vertical portion 112, a roof flange 114, an upper cover clip 116 and a lower cover clip 118. The strip of compressible tape 10 is applied to an inside surface of the vertical portion 112, below a bottom of the roof flange 114. With reference to FIG. 3, the top outer peripheral edge 120 of a building 115 is not perfectly flat. However, the flexibility of the anchor bar 108 and the compressibility of the strip of compressible tape 10 conforms to any dips in the roof membrane 104, which over lays the top peripheral edge 120 of the building 115. A plurality of fasteners 122 are used to secure the anchor bar 108 to the top outer peripheral edge 120 of the building 115 to ensure that there is not a leak path for any water to drip past the strip of compressible tape 10.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A fascia with seal for drip protection, comprising:

a strip of compressible tape; and the fascia includes an anchor bar, the anchor bar includes a vertical portion and a roof flange, the roof flange extends horizontally inward from the vertical portion, said strip of compressible tape is applied along a length of the vertical portion, below the roof flange, said strip of compressible tape extends from below the roof flange to a plurality of fasteners, wherein said strip of compressible tape is put in contact with a roof membrane of a roof, the plurality of fasteners are used to force said strip of compressible tape against the roof membrane which over lays a peripheral edge of a building having a surface with dips, said compressible tape seals the dips between the anchor bar and the roof membrane, said plurality of fasteners secure the fascia to a top outer peripheral edge of the building.

2. The fascia with seal for drip protection of claim 1 wherein:

the anchor bar includes an upper cover clip and a lower cover clip, the upper cover clip extends outward from a top of the vertical portion, the lower cover clip extends outward from a bottom of the vertical portion.

3. The fascia with seal for drip protection of claim 2 wherein:

a cover is snapped on to the upper cover clip and the lower cover clip.

4. A fascia with seal for drip protection, comprising:

a strip of compressible tape; and the fascia includes an anchor bar, the anchor bar includes a vertical portion and a roof flange, the vertical portion of the anchor bar is flexible, the roof flange extends horizontally inward from the vertical portion, said strip of compressible tape is applied along a length of the vertical portion, below the roof flange, said strip of compressible tape extends from below the roof flange to a plurality of fasteners, wherein said strip of compressible tape is put in contact with a roof membrane of a roof, the plurality of fasteners are used to force said strip of compressible tape against the roof membrane which over lays a peripheral edge of a building having a surface with dips, said compressible tape seals the dips between the roof membrane and anchor bar, said plurality of fasteners secure the fascia to a top outer peripheral edge of the building.

5. The fascia with seal for drip protection of claim 4 wherein:

the anchor bar includes an upper cover clip and a lower cover clip, the upper cover clip extends outward from a top of the vertical portion, the lower cover clip extends outward from a bottom of the vertical portion.

6. The fascia with seal for drip protection of claim 5 wherein:

a cover is snapped on to the upper cover clip and the lower cover clip.

7. A fascia with seal for drip protection, comprising:

a strip of compressible tape; and the fascia includes an anchor bar, the anchor bar includes a vertical portion and a roof flange, the roof flange extends horizontally inward from the vertical portion, said strip of compressible tape is applied along a length of the vertical portion, below the roof flange, said strip of compressible tape is not located between said roof flange and a horizontal portion of a roof membrane wherein said strip of compressible tape is put in contact with a vertical portion of the roof membrane of a roof, a plurality of fasteners are used to force said strip of compressible tape against the roof membrane, which over lays a peripheral edge of a building having a surface with dips, said compressible tape seals the dips between the roof membrane and the anchor bar, said plurality of fasteners secure the fascia to a top outer peripheral edge of the building.

8. The fascia with seal for drip protection of claim 7 wherein:

said strip of compressible tape is located above the plurality of fasteners.

9. The fascia with seal for drip protection of claim 7 wherein:

the anchor bar includes an upper cover clip and a lower cover clip, the upper cover clip extends outward from a top of the vertical portion, the lower cover clip extends outward from a bottom of the vertical portion.

10. The fascia with seal for drip protection of claim 9 wherein:

a cover is snapped on to the upper cover clip and the lower cover clip.

* * * * *